US012624596B2

(12) United States Patent
Leinenbach

(10) Patent No.: US 12,624,596 B2
(45) Date of Patent: May 12, 2026

(54) APPARATUS FOR FORMING LATERAL BORES IN SUBSURFACE ROCK FORMATIONS, WELLBORE STRING AND METHODS

(71) Applicant: Fishbones AS, Sandnes (NO)

(72) Inventor: Maximilian Leinenbach, Stavanger (NO)

(73) Assignee: Fishbones AS, Sandnes (NO)

( * ) Notice: Subject to any disclaimer, the term of this patent is extended or adjusted under 35 U.S.C. 154(b) by 54 days.

(21) Appl. No.: 18/566,398

(22) PCT Filed: Jun. 3, 2022

(86) PCT No.: PCT/NO2022/050127
§ 371 (c)(1),
(2) Date: Dec. 1, 2023

(87) PCT Pub. No.: WO2022/255883
PCT Pub. Date: Dec. 8, 2022

(65) Prior Publication Data

US 2024/0254836 A1 Aug. 1, 2024

(30) Foreign Application Priority Data

Jun. 3, 2021 (NO) ..... 20210699

(51) Int. Cl.
*E21B 7/06* (2006.01)
*E21B 7/18* (2006.01)
(Continued)

(52) U.S. Cl.
CPC ..... *E21B 7/061* (2013.01); *E21B 7/18* (2013.01); *E21B 17/20* (2013.01); *E21B 47/09* (2013.01); *E21B 41/0035* (2013.01)

(58) Field of Classification Search
CPC . E21B 7/061; E21B 7/18; E21B 17/20; E21B 47/09; E21B 41/0035;
(Continued)

(56) References Cited

U.S. PATENT DOCUMENTS 6,070,662 A 6/2000 Ciglenec et al.
6,260,623 B1 7/2001 Schick
(Continued)

FOREIGN PATENT DOCUMENTS

CN 107461186 12/2017
SU 1208197 1/1986

OTHER PUBLICATIONS

Norwegian Search Report for Corresponding Norwegian Application No. 20210699, dated Dec. 22, 2021.
(Continued)

*Primary Examiner* — Yanick A Akaragwe
(74) *Attorney, Agent, or Firm* — Andrus Intellectual Property Law, LLP

(57) ABSTRACT

Various apparatus, a wellbore string incorporating the apparatus, and a computer-implemented method are described, whereby in various examples at least one flexible elongate member is guided from a wellbore string toward a wall of the wellbore for forming at least one lateral bore in a subsurface rock formation for stimulating the formation. The apparatus in such examples has at least one controllable body which is controllable, based upon a detected downhole configuration of the controllable body and/or the wellbore string, to be positioned with respect to the wellbore string for providing at least one exit through which the flexible elongate member is extractable from the wellbore string for extracting the flexible elongate member through the exit in a desired and/or preferred direction.

21 Claims, 7 Drawing Sheets

(51) Int. Cl.
*E21B 17/20* (2006.01)
*E21B 41/00* (2006.01)
*E21B 47/09* (2012.01)

(58) Field of Classification Search
CPC ..... E21B 43/305; E21B 7/06; E21B 7/068; E21B 29/06; E21B 43/00; E21B 43/16; E21B 43/25; E21B 43/26
See application file for complete search history.

(56) References Cited

U.S. PATENT DOCUMENTS

| | | | | |
|---|---|---|---|---|
| 8,322,409 | B2 | 12/2012 | Freyer | |
| 8,991,245 | B2 * | 3/2015 | Fields | E21B 49/008 73/152.41 |
| 10,174,557 | B2 | 1/2019 | Freyer | |
| 2002/0005286 | A1 | 1/2002 | Mazorow et al. | |
| 2002/0175004 | A1 * | 11/2002 | Mazorow | E21B 7/061 166/66.4 |
| 2009/0218143 | A1 * | 9/2009 | Sanfelice | E21B 7/18 175/77 |
| 2009/0288884 | A1 | 11/2009 | Jelsma | |
| 2011/0017445 | A1 * | 1/2011 | Freyer | E21B 7/061 166/222 |
| 2017/0152727 | A1 | 6/2017 | Head | |
| 2019/0162037 | A1 | 5/2019 | Duphorne et al. | |

OTHER PUBLICATIONS

International Search Report and the Written Opinion for PCT/NO2022/050127 dated Aug. 30, 2022.

* cited by examiner

SECTION B-B

DETAIL D

DETAIL C

APPARATUS FOR FORMING LATERAL BORES IN SUBSURFACE ROCK FORMATIONS, WELLBORE STRING AND METHODS

CROSS-REFERENCE TO RELATED APPLICATIONS

This application is the U.S. national stage application of International Application PCT/NO2022/050127, filed Jun. 3, 2022, which international application was published on Dec. 8, 2022, as International Publication WO 2022/255883 in the English language. The International Application claims priority of Norwegian Patent Application No. 20210699, filed Jun. 3, 2021. The international application and Norwegian application are both incorporated herein by reference, in entirety.

FIELD

The present invention relates to wellbore operations, and in particular, to apparatus deployable downhole in a wellbore for forming small-diameter lateral bores that extend laterally and penetrate a subsurface formation through a wall of the wellbore for thereby stimulating the formation and facilitating the production of oil and gas from the subsurface.

BACKGROUND

In the oil and gas exploration and production industry, wellbores are constructed which extend into the Earth's subsurface. These may typically be several kilometers in length. Such a wellbore is typically completed using downhole completion equipment comprising screens, gravel pack, isolation packers, and production tubing. Upon operating the well, hydrocarbon fluids may enter the wellbore from a surrounding geological formation through the screen and travel up toward surface along the wellbore, inside the production tubing. The section(s) of the wellbore through which the hydrocarbon enters the wellbore is generally herein referred to as the production section(s).

Some reservoir formations, for instance when comprising low-permeability rocks such as carbonates, may require stimulation to encourage fluid from the reservoir rock into the wellbore. The published patent documents U.S. Pat. No. 8,322,409 (Fishbones A S) and U.S. Ser. No. 10/174,557 (Fishbones A S) describe solutions for forming lateral bores by jetting or drilling, which may provide suitable stimulation of the reservoir formation. In these solutions, a wellbore tubing string can be deployed in the main bore of the wellbore. When located in the section to be stimulated for production, flexible elongate members in the form of long thin tubular "needle" pipes or tubes (which may extend radially by up to 10 m for example) can be extracted and urged laterally from the tubing to form multiple lateral bores of small diameter (e.g. 1 to 2 cm diameter) in the reservoir formation, thereby stimulating the formation for facilitating the production of hydrocarbons. Formation fluids may then enter and be guided by the lateral bores into the main bore of the wellbore. By stimulating the formation in this way, greater production rates may be obtained from the wellbore. In some wells however, the far reaches of wellbores may extend horizontally into the reservoir along very thin reservoir formation beds. In such circumstances, correct penetration of the formation by the elongate members may be a challenge, and the inventors have for example noted that tapping, e.g. of water and/or gas, in unwanted zones near the pay zone in the subsurface can be a particular risk. In general, it is noted that it may be beneficial or desirable to stimulate thin reservoir beds or particular regions of the subsurface with further accuracy, precision, and/or reliability to target the reservoir rocks to be stimulated. At least one object of the invention is to obviate or at least mitigate one or more drawbacks of prior art.

SUMMARY

According to a first aspect of the invention, there is provided apparatus for guiding at least one flexible elongate member from a wellbore string toward a wall of the wellbore for forming at least one lateral bore in a subsurface rock formation for stimulating the formation, the apparatus being configured to be incorporated in the wellbore string and comprising at least one controllable body which is controllable, based upon a detected downhole configuration of the controllable body and/or the wellbore string, to be positioned with respect to the wellbore string for providing at least one exit through which the flexible elongate member is extractable from the wellbore string for extracting the flexible elongate member through the exit in a desired and/or preferred direction.

The controllable body may comprise at least one exit port for permitting the flexible elongate member to extend through a structure of the controllable body. The structure may be a wall structure. The exit port may be a wall port.

The controllable body may comprise at least one exit part for supporting and/or guiding the flexible elongate member through the exit. The exit part may be an exit port extending through a wall structure of the controllable body.

The controllable body may be rotatable for positioning the body with respect to the string. The controllable body may be movable in any other suitable manner to bring controllable body to a suitable position with respect to the string for providing the exit in the desired and/or preferred direction.

The controllable body may comprise a sleeve having at least one exit port in a wall structure of the sleeve, such that the flexible elongate member may be extractable from inside the sleeve and through the exit port of the sleeve. The sleeve may be arranged inside a housing.

The apparatus may include a further body, and the controllable body may be arranged on an inside or an outside of the further body. The further body may thus be an inner body and the controllable body may be an outer body. Alternatively, the further body may be an outer body, and the controllable body may be an inner body. The further body may comprise a housing. The further body, e.g. the housing, may comprise at least one window or opening, and the controllable body may be controllable to be positioned with respect to the window or opening for permitting the controllable body to provide an exit through the window or opening in the desired or preferred direction.

The housing may comprise a plurality of windows or openings along a circumference of the housing, and the controllable body may be operable to be rotated to obtain alignment with one of the windows or openings for providing an exit for the flexible elongate member through the window or opening in the desired or preferred direction.

The apparatus may further comprise at least one sensor for determining or detecting a circumferential position or orientation of the controllable body within the wellbore. The sensor may comprise at least one orientation sensor. The orientation sensor may comprise any one or more of an accelerometer, an inclinometer, a compass, and/or a gyroscopic sensor.

The apparatus may further comprise at least one determiner for determining an amount of required movement of the controllable body for positioning the controllable body with respect to the string for providing the exit in the desired or preferred direction. The determiner may be configured to be operable for determining the position of the controllable body relative to a position of a window of a housing inside of which the controllable body is positioned and/or determining the window which allows or most closely allows extraction of the flexible elongate member in the desired direction and/or determining the movement of the controllable body required to provide the exit through said window. The determiner may comprise a computer device.

The apparatus may further comprise a motor, preferably an electric motor, for moving the controllable body with respect to the string for providing the exit for extracting the flexible elongate member in the desired direction.

The apparatus may further comprise at least one battery for supplying electrical power to the electric motor. Power may alternatively be supplied by other means.

The apparatus may further comprise a controller for controlling and operating the electric motor in dependence upon the detected configuration of the controllable body for moving the controllable body with respect to the string for obtaining the exit for the flexible elongate member from the string.

The electric motor may be arranged to turn at least one gear member for rotating the controllable body circumferentially with respect to the string. The controllable body may be configured to be coupled rotatably through the gear member to the string.

The controllable body may be a sleeve arranged to rotate within the housing. The housing may have a gear ring, and the electric motor may be mounted to the sleeve and operable to rotate a pinion gear member which may be arranged to engage with the gear ring to rotate the sleeve about a longitudinal axis of the string with respect to the housing for positioning the sleeve.

The sleeve may incorporate any one or more of: a battery for supplying power for the electric motor; a controller for controlling the movement of the motor; a sensor for detecting the configuration such as the rotational orientation of the sleeve; a determiner for determining the movement of the sleeve; electrical circuitry for operating the motor, sensor, and/or determiner.

The apparatus may in some embodiments further comprise a further body which may be an elongate body comprising end portions. The further body may be considered a main body. The further body may be incorporated into the wellbore string, e.g. by screwing either or both end portions to adjacent sections of the string. The further body may thus be configured to be connected in fixed relationship with respect to the string. The further body may be an inner main body with the controllable and movable body being arranged to be supported upon the further body and rotate with respect to the further body. The controllable body may be movable around an outside at least one section of the further body. The controllable body may comprise a sleeve which may extend around the further, e.g. main, body and which may be rotatable about a long axis of the further body for orienting the controllable body and providing an exit for the flexible tubular member in desired or preferred direction. The further body may comprise an inner body, and the sleeve may be an outer sleeve. The further body may comprise one or more openings through a wall of the further body, and the controllable body may have one or more exit ports, for alignment with the one or more openings for providing the exit for the flexible elongate members in the desired direction.

The apparatus may in some embodiments further comprise the housing, and in such embodiments the housing may be an elongate housing which may comprise a first end portion configured to be connected to a first section of the string and a second end portion configured to be connected to a second section of the string for incorporating the apparatus into the string. The housing may comprise one or more openings through a wall of the housing. The controllable body may be movably coupled to the housing for movement into different rotational positions circumferentially with respect to the housing. The controllable body may comprise at least one port. The apparatus may comprise at least one actuator and/or motor for moving the controllable body with respect to the housing based upon a determined movement instruction to obtain a desired position of the controllable body relative to the housing, whereby in the desired position, the port of the body may be aligned with the opening of the housing for guiding the flexible elongate member through the aligned port and opening toward the formation in the desired or preferred direction. The movement instruction may be determined by a determiner or computer device and may be based upon the detected configuration or orientation of the housing in the wellbore.

The apparatus may be in the form of a downhole sub.

In certain embodiments, apparatus for guiding at least one flexible elongate member from a wellbore string toward a wall of the wellbore for forming at least one lateral bore in a subsurface rock formation for stimulating the formation is provided, the apparatus being configured to be incorporated in the wellbore string, the apparatus comprising: a housing configured to be connected to a section of the wellbore string; a controllable sleeve rotatably arranged inside the housing; means for detecting a downhole circumferential position or downhole configuration of the sleeve within the wellbore, in use; and a motor; wherein the sleeve is rotatable with respect to the housing via the motor, based upon the detected downhole circumferential position or detected downhole configuration of the sleeve, into a position in which an exit port of the sleeve is aligned with a window of the housing, such that the aligned exit port and window together provide at least one exit through which the flexible elongate member is extractable from an inside of the wellbore string in a desired and/or preferred direction toward the wall of the wellbore. In such embodiments, the apparatus may have any one or more further features as described further above in relation to the apparatus of the first aspect of the invention. The means for detecting the downhole circumferential position or downhole configuration of the sleeve within the wellbore in use, may comprise at least one sensor which may comprise at least one orientation sensor.

In certain embodiments, apparatus for guiding at least one flexible elongate member from a wellbore string toward a wall of the wellbore for forming at least one lateral bore in a subsurface rock formation for stimulating the formation is provided, the apparatus being configured to be incorporated in the wellbore string, the apparatus comprising: a housing configured to be connected to a section of the wellbore string; a controllable body movably arranged inside the housing; means for detecting a downhole circumferential position or downhole configuration of the controllable body within the wellbore, in use; and a motor; wherein the controllable body is movable with respect to the housing via the motor, based upon the detected downhole circumferential position or detected downhole configuration of the controllable body, into a position in which an exit part of the controllable body is aligned with a window of the housing, such that the aligned exit part and window together provide at least one exit through which the flexible elongate member is extractable from an inside of the wellbore string in a desired and/or preferred direction toward the wall of the wellbore. In such embodiments, the apparatus may have any one or more further features as described further above in relation to the apparatus of the first aspect of the invention. The controllable body may be rotatably arranged inside the housing, and the controllable body may be rotatable with respect to the housing via the motor. The controllable body may be or may comprise a sleeve, and the exit part is or comprises an exit port. By being movably arranged inside the housing, the controllable body may be moved circumferentially by the motor around a longitudinal axis of the wellbore, in use. The means for detecting the downhole circumferential position or downhole configuration of the sleeve within the wellbore in use, may comprise at least one sensor which may comprise at least one orientation sensor.

According to a second aspect of the invention, there is provided a wellbore string incorporating at least one apparatus in accordance with the first aspect of the invention. The wellbore string may be a tubular string, e.g. a casing or tubing string.

The wellbore string may further include the at least one flexible elongate member, which may be or comprise any one or more of a tube, rod, pipe, needle, etc. The flexible elongate member may be provided with at least one pressure surface configured to have pressure imparted by fluid in the string to urge the flexible elongate member along the inside of the string and extract the flexible elongate member laterally or radially from the sting. The flexible elongate member may have a penetrating end which may be provided with a jetting nozzle or a rotary bit. In examples with the rotary bit, the flexible elongate member may be translated from the exit. The rotary bit may rotate relative to the body of the flexible elongate member upon which the bit may be mounted. The rotary bit may accordingly be used for drilling the lateral bore. Fluid may be transmitted through the inside of the flexible elongate member and may exit through a hole in or near the bit to facilitate cutting and transport of debris material along the outside of the flexible elongate member and away from the bit during the drilling process. In examples with the jetting nozzle, fluid may be transmitted inside the flexible elongate member and jetted out of the nozzle to form the lateral bore. Jetting fluid and material removed from by excavation of the formation through jetting is transported along the outside of the flexible elongate member and away from the nozzle during the jetting process. In embodiments where a fluid may be transmitted through an inside of the flexible elongate member, the flexible elongate member may be tubular, e.g. the flexible elongate member may be or comprise any one or more tube, pipe, tubular rod, or tubular needle, etc.

The controllable body may comprise at least one port for supporting and guiding the flexible elongate member upon exiting from the string.

The controllable body may be operable to reconfigure the string between a first, non-oriented configuration, wherein the controllable body can have an arbitrary position with respect to the string, and a second, oriented configuration, wherein the controllable body can be positioned with respect to the string for allowing the flexible elongate member to exit from the string in the desired or preferred direction. The controllable body may be configured to be positioned in response to actuation in dependence upon the detected configuration within the wellbore, whereby during actuation an end portion of the flexible elongate member to be deployed may be located and/or supported in an exit port of the controllable body, such that upon positioning the controllable body from the first configuration to obtain the second configuration the end of the flexible elongate members may be moved with the controllable body. The configuration in the wellbore may be an orientation of the body or other part of the apparatus.

The flexible elongate member may be provided with at least one pressure surface or other member for permitting pressure to be exerted by fluid in the string for urging the flexible elongate member along the string and extracting a penetrating end of the flexible elongate member through the exit provided by the positioned body.

The wellbore string typically includes multiple flexible elongate members. Thus, several bores can be produced to stimulate the formation by the plurality of flexible elongate members. The apparatus in such embodiments may have at least one controllable body which is controllable based upon the detected downhole configuration of the controllable body and/or the wellbore string, to be positioned with respect to the wellbore string for providing respective exits through which the flexible elongate members are extractable from the wellbore string for extracting the flexible elongate members through the respective exits in desired and/or preferred directions.

The apparatus may have, in addition to the controllable body, at least one further controllable body which is controllable, based upon a detected downhole configuration of any of the further controllable body, the controllable body, and/or the wellbore string, to be positioned with respect to the wellbore string for providing at least one exit through which the flexible elongate member is extractable from the wellbore string for extracting the flexible elongate member through the exit in a desired and/or preferred direction. Thus, the controllable body and the further controllable body may each provide at least one exit. In embodiments with multiple flexible elongate members, the controllable body and the further controllable body are controllable to be positioned with respect to the wellbore string for providing respective exits through which the flexible elongate members are extractable from the wellbore string for extracting the flexible elongate members through the respective exits in desired and/or preferred directions provide respective exits. Thus, the rods may be extracted from controllable body and further controllable body at different positions along the wellbore string, where the flexible elongate members may be extracted through the respective exits.

The lateral bore or bores may each have a diameter in the range of up to 2 cm for example a diameter in the range of 1 to 2 cm. The flexible elongate member or one or more flexible elongate members may have a diameter in the range of up to 2 cm, for example a diameter in the range of 1 to 2 cm.

According to a third aspect of the invention, there is provided a method of positioning an exit for extracting at least one flexible elongate member from the wellbore string of in accordance with the second aspect of the invention in a desired or preferred direction in the subsurface.

The method may further comprise using at least one computer device to determine a position of the exit to be obtained. The method may further comprise sending instructions to an actuator to position the controllable body. The method may be at least partially computer implemented.

According to a fourth aspect of the invention, there is provided a computer device for use in performing the method of the third aspect.

According to a fifth aspect of the invention, there is provided a computer program which when executed by the computer device of the fourth aspect to determine the position of the exit in the method of the third aspect.

According to a sixth aspect of the invention, there is provided a method of stimulating a wellbore using the wellbore string in accordance with the second aspect of the invention.

The apparatus, wellbore string, and methods of any of the aspects of the invention may have one or more further features as described in relation to any of the other aspects of the invention wherever described herein.

Embodiments of the invention are advantageous in various ways as will be apparent from throughout herein.

BRIEF DESCRIPTION OF THE DRAWINGS

There will now be described, by way of example only, embodiments of the invention with reference to the accompanying drawings, in which.

DETAILED DESCRIPTION OF THE DRAWINGS

Figure 1:
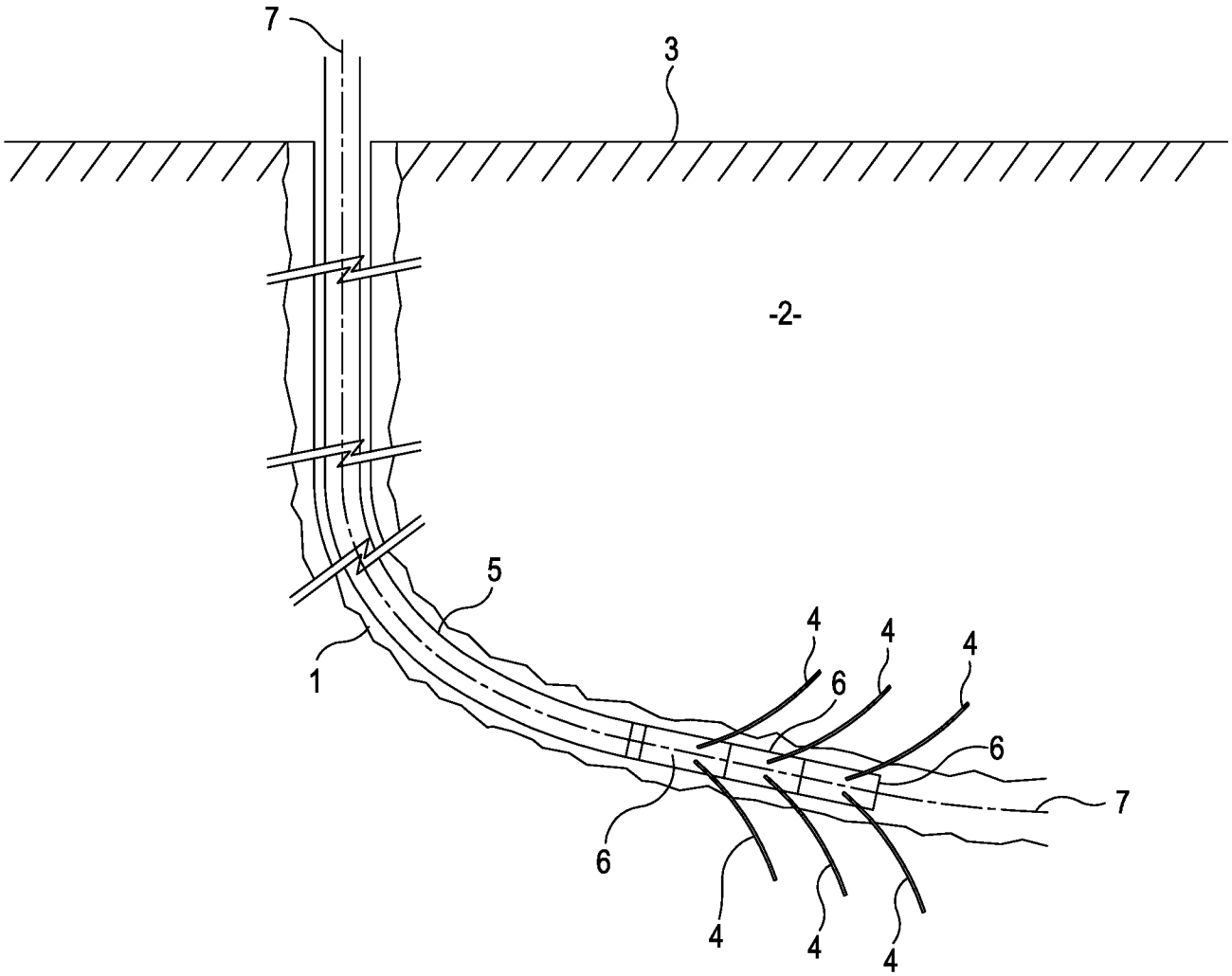
FIG. 1 is a schematic representation of wellbore string in use in a wellbore.

Referring firstly to FIG. 1, a wellbore 1 extends from the Earth's surface 3 into geological formations 2 of the subsurface. In connection with the construction and/or completion of the wellbore 1, a tubular wellbore string 5 has been advanced into the deviated, far reaches of the wellbore 1, carrying with it flexible elongate members in the form of flexible tubes 4 for forming lateral bores and stimulating the formation. During the run in of the wellbore string 5, the flexible tubes 4 are contained inside the string 5 in retracted configuration (not shown in FIG. 1). When the string 5 has been sufficiently advanced, the flexible tubes 4 are extracted from the wellbore string 5 into the configuration as shown in FIG. 1. To this end, the wellbore string 5 includes downhole subs 6 from each of which in this example two tubes 4 are extracted. The downhole subs 6 are described further in the following. However, it can be noted first that each sub 6 includes a controllable body which is rotatable depending upon its orientation within the wellbore 1 to position the exits for the flexible tubes 4 to be extracted from the wellbore string 5 in desired or preferred directions. In order to extract the tubes 4, the tubes 4 are pushed by applied pressure axially within the wellbore string 5 and as they are extracted are guided out of exit ports in the sub 6 on a trajectory through the wall of the wellbore 5 toward and into the surrounding formation 2. The penetrating ends of the tubes 4 are for example provided with jet nozzles that jet fluid into the formation 2 to dissolve or remove material ahead of the respective jet nozzles to form lateral bores which extend away from the wellbore 5 into the formation. Alternatively, the penetrating ends of the tubes 4 are provided with rotary bits that turn about an axis of the tube to drill into the formation to form the lateral bores. By suitable pre-orienting of the exits for the tubes therefore, the tubes 4 can be guided into and form lateral bores in the formation in directions desired. Thus, targeted stimulation of formations of specific regions of the subsurface and in certain directions may be achieved. The direction and region of the subsurface in which lateral bores are formed may be better controlled, as the tubes may be deployed more precisely through the orientation mechanism, and unwanted tapping of fluids from regions near a reservoir pay zone can be avoided.

Figure 2B:
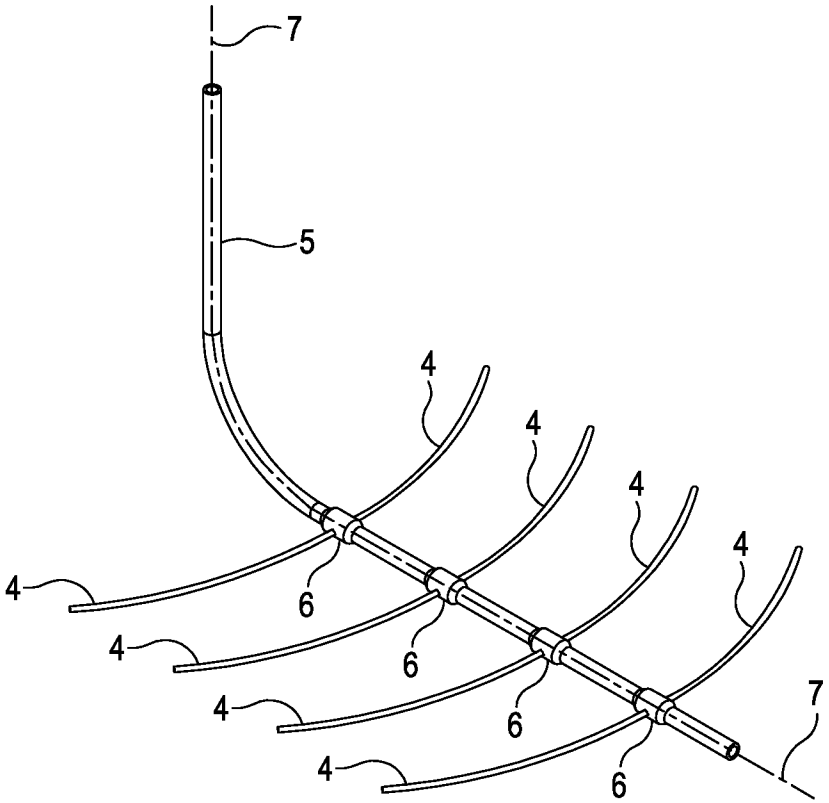
FIGS. 2A and 2B are schematic perspective representations of the wellbore string of FIG. 1 in different use configurations, after extraction of mini tubes, in larger scale.
Figure 2A:
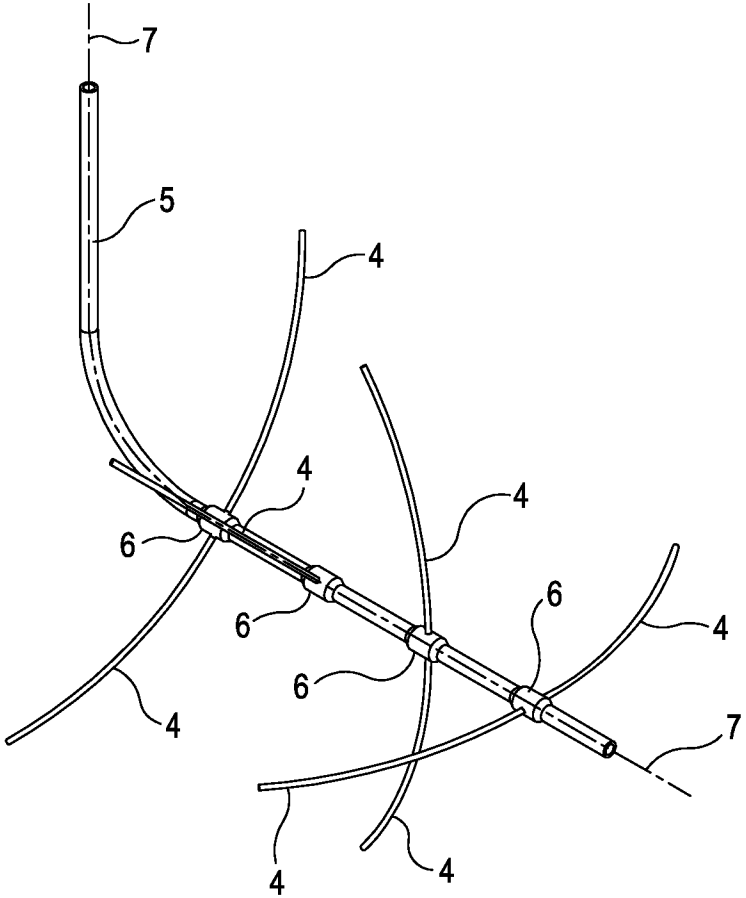

Depending upon requirements, the subs 4 can be configured to extract the tubes 4 in certain configurations and directions with respect to the wellbore. In FIGS. 2A and 2B, different tube configurations are depicted. In FIG. 2A, the tubes 4 of each sub 6 extend laterally from exits arranged circumferentially 180 degrees apart in opposite directions. The exits from one sub 6 to another are in different rotational positions about the longitudinal axis 7 of the wellbore string 5. In FIG. 2B, the tubes 4 of one sub 6 extend generally in parallel with the tubes 4 of another sub 6, for example horizontally.

Figure 3:
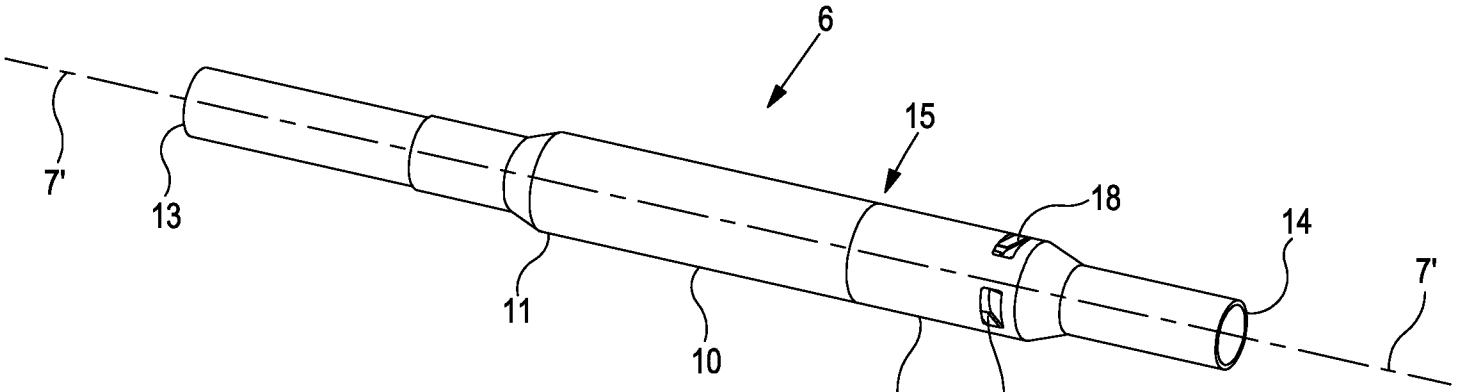
FIG. 3 is a perspective representation of apparatus to be incorporated in the wellbore string of FIG. 1 for extracting a tube for forming a lateral bore in a desired direction, in larger scale.
Figure 4:
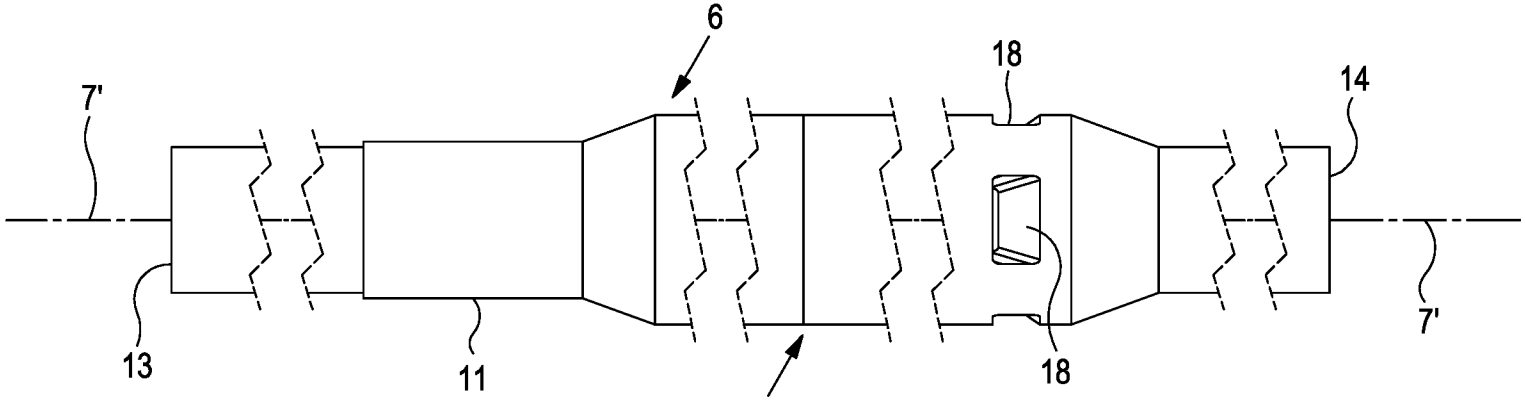
FIG. 4 is a side representation of the apparatus of FIG. 3, in larger scale.

Turning now to FIGS. 3 and 4, a sub 6 is depicted in further detail. The sub 6 in this example has an elongated cylindrical housing 10 that extends longitudinally between first and second ends 13, 14. The housing 10 is tubular with a longitudinal centre axis 7' extending through a longitudinal bore of the housing 10 between the first and second ends 13, 14. The first end 13 is provided with a box section for threadedly connecting the first end of the housing 10 to the pin section of a first adjacent section of the wellbore string 5, and the second end 14 is provided with a pin section for threadedly connecting the second end of the housing 10 to the box section of a second adjacent section of the wellbore string 5. In this way, the housing 10 can be securely fastened and integrated into the wellbore string 5 in fixed relationship to the adjoining tubular sections of the string.

The housing 10 comprises first and second parts 11, 12 which are joined together for incorporation in the string. The first and second parts 11, 12 are joined by threaded joint 15 whereby the parts are firmly connected and provide a structurally robust structure that remains connected and intact during operation in the well. Yet the two parts 11, 12 can allow the components of the sub 6 to be assembled and incorporated into the sub 6, before the sub 6 is inserted into the string 5. The second part 12 of the housing 10 has windows 18 in the housing wall. A tube 4 can exit laterally from sub 6 through a suitable window 18 for penetrating the formations 2 of the subsurface radially surrounding the wellbore 1 in use.

Figure 5:
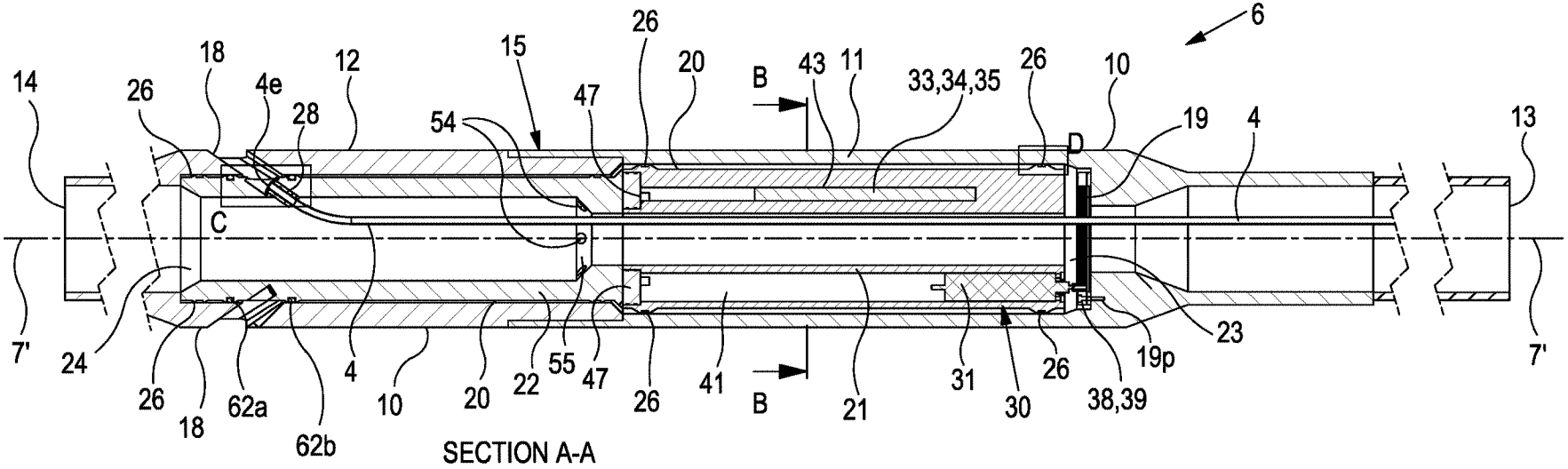
FIG. 5 is a cross sectional representation along the line AA of FIG. 6.
Figure 7:
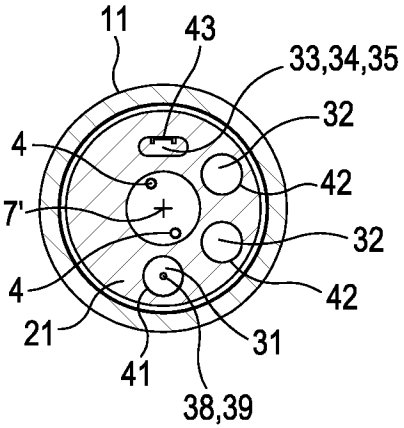
FIG. 7 is a cross sectional representation along the line BB of FIG. 6.
Figure 9:
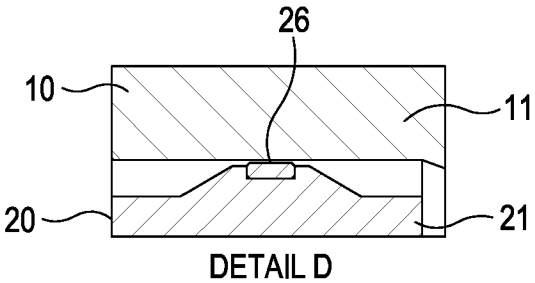
FIG. 9 is a close-up representation of the part of the apparatus inside the frame D of FIG. 6.
Figure 6:
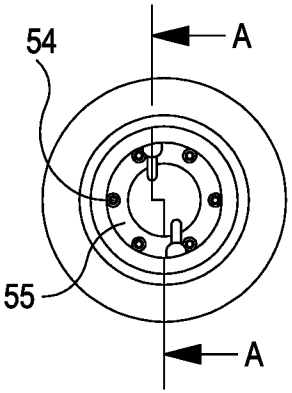
FIG. 6 is a sectional representation of the apparatus of FIG. 3.

The sub 6 in assembled condition will now be described further with reference additionally to FIGS. 5 to 9 where details can be better seen. The sub 6 has a controllable inner body 20, arranged inside the housing 10. The controllable inner body 20 is movable, in this example being rotatable about the longitudinal axis 7, 7', with respect to the housing 10. The controllable inner body 20 is in the form of tubular alignment sleeve that extends longitudinally within and is arranged coaxially with the housing 10. The inner body 20 is configured to support the tube 4. In this example, the controllable inner body 20 has a wall port 28 for supporting and guiding the tube 4 upon extraction from the sub 6. As can be seen, a penetrating end 4*e* of the tube 4 in the configuration of FIG. 5 is supported in the opening of a port 28. This is the configuration of the sub 6 during run-in of the wellbore string 5, where the tube 4 is retracted and contained within the wellbore string 5. The tube 4 extends in an interior of the housing 10. This configuration is maintained until the intended destination for extracting the tubes 4 and forming the lateral bores is reached.

The inner body 20 is operable to rotate about the axis 7, 7' to a position in which the wall port 28 of the inner body 20 is aligned with a window 18 of the housing 10 and provides an exit for the tube 4 in a desired, predetermined direction into the subsurface 2. The desired direction typically differs from that which may otherwise be attainable by simply running the wellbore string into the well, because in general the rotational orientation of the string 5 at far reaches of the well is not controllable. Thus, as will be described further in the following, the inner body 20 in this example is actively rotatable in response to detected configuration or orientation of the sub 6 within the wellbore in order to obtain alignment of the wall port 28 and the window 18 to provide the exit for the tube 4 and doing so such that the obtained alignment also provides for the tube 4 to exit the sub 6 in the desired or known direction within the subsurface or wellbore to within an acceptable margin of error, for targeting a particular region of the formation of interest. To this end therefore typically, the window 18 is configured to have an opening which extends circumferentially to allow alignment of the wall port 28 with the window opening 18 in several rotational positions of the inner body 20. Several windows 18 can be provided so that an opening through the housing wall is available for alignment with the wall port 28 of the inner body 20 whatever the direction chosen for the exit with respect to the wellbore. By rotation of the controllable inner body 20 with the tube 4 supported in the wall port 28 in this example the tube 4 is simultaneously urged together with the wall port 28 into position for extraction where it is aligned with the window 18 and can be extracted in the desired or preferred direction. In FIG. 5, the wall port 28 of the controllable body 20 is depicted in alignment with the window 18 of the housing 10.

The controllable inner body 20 in this example has first and second body portions 21, 22 which are connected to one another and extends longitudinally between forward and rearward ends 23, 24. The second body portion 22 is arranged forward of the first body portion 21 and includes the wall port 28 for extracting the tube 4. The tube 4 is arranged in a central bore of inner body 20 through the first body portion 21 and the second body portion 22 and extends along the bore arcing outward to the wall port 28 where it is supported. The rearward, first body portion 21 forms an enclosure for accommodating operation and control apparatus 30 for operating the sub 6 for rotating the inner body 20 into position.

The operation and control apparatus 30 includes an electric motor 31, batteries 32, a gyroscopic sensor 33, and a computer device 34 with pressure data input 35. The batteries 32 are used to supply electrical power to the motor 31, the gyroscopic sensor 33, and the computer device 34. Suitable connections (not shown) are provided between these components of the operation and control apparatus 30 for communicating power, data and/or signals as required.

The first body portion 21 comprises a tubular having a longitudinally extending channel 41 or pocket in the material of the wall structure of the tubular for accommodating the motor 31. The motor 31 is fitted in the channel 41 toward the rearward end of the controllable inner body 20. Thus, the motor 31 is positioned in the wall structure of the tubular. Notably, the motor 31 has a motor shaft 38 which extends in a longitudinal direction of the inner body 20 and protrudes from the rearward end 23. The motor shaft 38 is rotatable about its long axis and includes a gear 39. The gear 39 is operable by rotation of the shaft 38 to be turned about the shaft axis. The gear 39 is arranged in engagement with a gear ring 19 on the outer housing 10 of the sub 6. The gear ring 19 is fixed to a wall of portion of the outer housing using a fastener 19*p*, such as at least one screw, pin or other suitable fastener. The gear ring 19 extends ringwise on a circumference of an inner wall of the outer housing 10. By operating the motor 31 the shaft 38 and gear 39 are turned and by virtue of engagement of the gear 39 with the gear ring 19, the gear 39 is urged to travel orbitally along the gear ring 19, as a result of which a component of force is imparted to the controllable inner body 20 to cause it to rotate.

The controllable inner body 20 can in this way be rotated clockwise or anticlockwise about the longitudinal axis 7' as far as required, relative to the outer housing 10, by appropriate operation of the motor 31 to achieve the relevant alignment of the wall port 28 for extracting the tube in the desired direction.

Similarly, further channels 42 are provided in the material of the wall structure of the tubular of the first body portion 21 for accommodating the batteries 32. A yet further channel 43 is provided in the wall structure for accommodating the gyroscopic sensor 33 and the computer device 34. The channels 41, 42, 43 are sealed by a cap 47 at the forward end of the channels so as to protect the contents of the channels. The cap 47 can also incorporate electrical connectors for connecting between the components in different channels for electrical and/or data communication. The first and second main body portions 21, 22 are connected together by screws 54 which extend in the longitudinal direction through an internal shoulder 55 in the second part and into screw engagement with the second body portion 21. Any other fastener such as fastening pins, studs, or bolts can be alternatively used.

To facilitate the rotation of the inner body 20 friction reducers 26 are provided between the inner body 20 and the outer housing 10. In some examples, the friction reducer is a bearing. Alternatively, it can be a low-friction ring such as a polytetrafluoroethylene (PTFE) ring or the like to provide suitable low friction behaviour against the outer housing 10. The friction reducers 26 are disposed on shoulder formations which protrude from an outer surface of the inner body 20. The shoulders may thus provide a standoff from an inner surface of the housing 10 and limit the area of friction contact therebetween. The inner body 20 thus bears against the outer housing 10 on the friction reducer. The friction reducers 26 can facilitate to allow low friction rotation of the controllable inner body 20 relative to the outer housing 10.

Operation of the motor 31 to rotate the inner body 20 into required rotational orientation to prepare the sub 6 for extracting the tubes 4 takes place in dependence upon data from the gyroscopic sensor 33 with instructions being issued from the computer device 34.

The gyroscopic sensor 33 is used to detect the configuration of the sub 4 in the wellbore. For example, the gyroscopic sensor 33 can comprise an accelerometer arranged to detect the gravitational vector. The rotational orientation of the sub can be defined relative to the gravitational vector using data from the gyroscopic sensor 33. Thus, the orientation of the sub 6, i.e. the position rotationally about the longitudinal axis 7, 7', when deployed in the wellbore can be obtained using the data from the gyroscopic sensor 33. Based upon the determined rotational orientation of the sub 6 and/or rotatable body 20 in the wellbore, the motor 31 is driven to rotate the controllable inner body 20 to the required position in which port 28 is aligned with a window 18 of the outer housing 10 and the tube 4 can exit in the desired and/or predetermined direction and penetrate into the surrounding formation.

An algorithm can be developed for this functionality to be achieved. In the case of a thin horizontal bed sought to be stimulated by the tubes 4 from the sub 6 when located in a near-horizontal section of the wellbore, it may for example be sought to extract the tubes in a horizontal direction from the sub, and in such an example therefore an exit is correspondingly required to be positioned at 90 degrees about the longitudinal axis (where 0 degrees represents a vertical direction in geographical coordinates). The outer housing is designed to have windows 18 and/or window openings which regardless of the orientation about the axis 7' to allow access out of the sub 6 in the 90 degree direction once the rotatable body 20 has been actuated and brought into alignment with that direction. The algorithm determines the amount of rotation needed, e.g. number steps or duration of operation of the motor 31 required to reach the position. This can be based upon any of: the location of the window 18; the window size 18; the location of the port 28; and the shortest route of rotation. The shortest route can be beneficial for avoiding undue manipulation of the tubes inside the sub, and/or reducing battery usage and/or power requirements. Data is obtained from a pressure sensor (not shown) for measuring the pressure in the wellbore local to the sub 6. The data from the pressure is sensor is indicative of the position in the well and is obtained through the pressure data input 35. The pressure data can be used to activate the operation and control apparatus 30 for example when it reaches a certain value indicative of location in the well.

Figure 10:
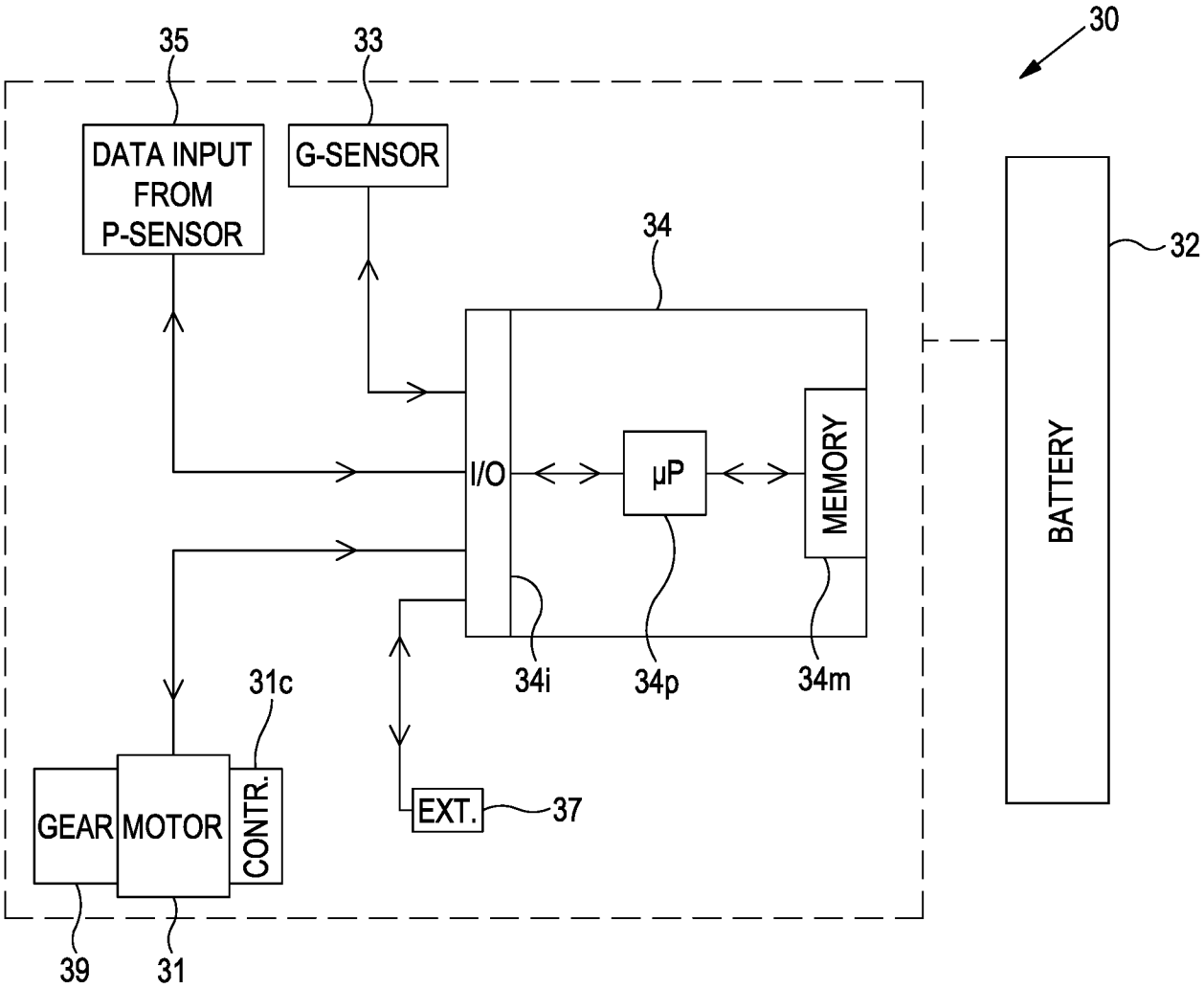
FIG. 10 is a block representation of operating and control means including a computer device for operating the apparatus of FIGS. 3 to 9.

Referring additionally to FIG. 10, the operation and control apparatus 30 can be further understood. The computer device 34 has a processor 34*p*, memory 34*m*, and an In/Out device 34*i*. The In/Out device 34*i* is used to communicate in and/or out between the computer device 34 and each of the gyro sensor 33, the motor 31, the pressure data input 35, and external signal means 37. The pressure data input 35 communicates pressure data from a pressure sensor which detects the pressure in the wellbore. The pressure data is used for activation of the operation and control apparatus 30 when required. For example, when the pressure has reached a certain level, it might be reliably determined from the detected pressure on the known pressure profile of the wellbore, that the sub is located appropriately for stimulation of the formation and can be activated. The external signal means 37 can for example provide for communicating status information concerning the status of the operation and control apparatus 34 to surface or to other systems of the wellbore string or wellbore. The processor 34*p* is used for communicating instructions to the motor 31 for operating the motor, typically via a motor controller 31*c*. The processor 34*p* is used for processing the data from the gyroscopic sensor 33 and the pressure data input 35. The processor 34*p* is configured to execute one or more computer programs for driving the motor 31 as necessary in dependence upon the received data. The memory 34*m* is configured to store the one or more computer programs. The computer programs comprise instructions which when executed cause the computer device 34 to drive the motor 31 and/or motor controller 31*c* to actuate rotation of the rotatable body 20 in the required fashion. The memory 34*m* may also store data such as various initial values which may be utilised in the one or more computer programs. These data may for example include data which define the configuration of components of the sub such as the position and size of windows and ports, and/or the desired direction to be obtained for the exit of the tubes, i.e. data for defining the desired position of port 28 of the rotatable body in the geographical reference frame.

In practice therefore, the operation and control apparatus 30 can thus be automatically activated, e.g. based on data from the pressure sensor 35, once positioned in the relevant section of the wellbore. Under control from the computer device 34, the rotatable inner body 20 is actuated and rotates to orient the body to provide suitably directed exits for the tubes 4 from the sub 6. Once the rotatable body 20 is rotated and oriented within the string, the tubes 4 are extracted. Fluid in the string imparts a pressure upon one or more surfaces of the tubes 4 and by way of the imparted pressure from the fluid thereby urges the tubes 4 out through the ports 28 in the wall 22 toward the formation.

Figure 8:
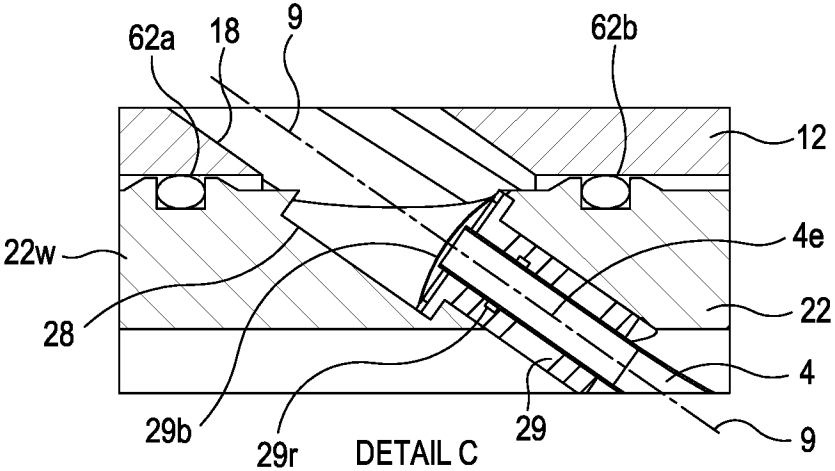
FIG. 8 is a close-up representation of the part of the apparatus inside the frame C of FIG. 6.

In FIG. 8, detail relating to the wall port 28 of the second body portion 21 is depicted. The wall port 28 in this example comprises a guide sleeve 29 secured to the second body portion 22 of the controllable inner body 20. The tube 4 is disposed and supported slidably in a bore of the guide sleeve 29 and movable axially along the bore axis 9 when the tube 4 is to be extracted from the sub in use. A seal 29*r* is arranged around the tube 4 on the wall of the guide sleeve 29 for sealing between an outer surface of tube 4 and the wall of the guide sleeve 29. The bore of the guide sleeve 29 extends outward through the material of the body 20 at an acute angle with respect to the longitudinal axis 7, 7'. The angle and shape of the bore is adapted suitable to accommodate the bending of the tube 4 outward from the configuration generally parallel with the long axis toward a direction lateral to the long axis 7, 7'. It can also be noted from FIG. 8 that ring seals 62*a*, 62*b* are provided around the inner body axially forward and rearward of the ports 28 to seal between an inner wall of the outer housing 10 and an outer wall of the inner body 20. In this way, the seals 62*a*, 62*b* can isolate the exit passage for the tube through wall port 28 and window 18. Thus, fluid ingress and pressure leakage into the passage can be restricted or prevented which may facilitate extraction the tubes. Furthermore, the end 4*e* is provided with a burst disc 29*b* which seals over the end 4*e* of the tube 4 in the guide sleeve 29 during deployment into location downhole in the wellbore 1. When the tube 4 is to be extracted, the end 4*e* of the tube 4, e.g. with the drill bit or jetting nozzle thereupon, is pushed through the guide sleeve 29 to break the burst disc to exit the sub 6 toward the wall of the wellbore and the formation.

The above provides mere examples of how the apparatus may be configured and operated, and clearly a wide range of other variants are possible. It can be appreciated for instance the operation and control apparatus 30 could in alternative variants be incorporated into the stationary housing 10, rather being part of the rotatable inner body 20. In one variant for example, the motor 31 is fixed to an inside wall of the housing with the drive shaft 38 with the gear 39 extending longitudinally to engage with the ring gear on the rotatable inner body 20. The sensors, computer device, and battery in such variants can be accommodated in a pocket or the like in the wall structure of the outer housing 38. In other variants, different actuation mechanisms can be employed where for example the motor is a hydraulic motor.

In further variants, the controllable body is movable inside the housing 10 along the sub to position the ports 18 and 28 in alignment. The body also does not have to be in the form of a sleeve, for example an element comprising a port or supporting structure for the tube can be moved to alignment with a window 28 on a track or guide formed inside the housing, e.g. following a cam on a wall of the housing. The controllable body in such cases can have an exit part or port for supporting the flexible elongate member for providing an exit for the flexible elongate member when the exit part or port is aligned with a window or opening of the housing.

Figure 11:
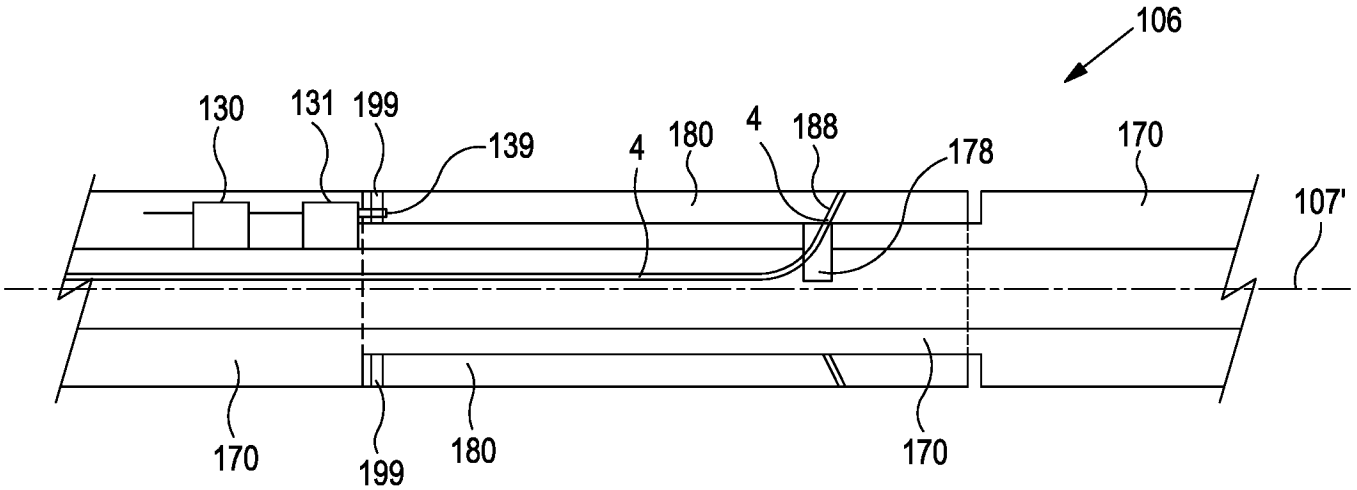
FIG. 11 is a schematic sectional representation of another apparatus configured to be incorporated in the wellbore string of FIG. 1 for extracting a flexible tube for forming a lateral bore in a formation of the subsurface, in a different scale.

Another variant is depicted in FIG. 11, in which apparatus comprising the sub 106 including a controllable body arranged on a further, inner body which is configured to be fixedly connected to the string. The inner body is in the form of a tubular mandrel 170 which at each end is screwed into adjacent components of the wellbore string to form an integral part of the string. The controllable body is in the form of a sleeve 180 is disposed rotatably about the mandrel 170 which extends through the sleeve 180 on an inside thereof. A flexible tube 104 from an inside of the wellbore string extends into the mandrel 170 through a window 178 the mandrel and is supported in a wall port 188 of the sleeve 180. The sleeve 180 is rotatable relative to the mandrel 170 (and thus the string) under actuation from the operation and control apparatus 130 via motor 131 which has a gear 139 on the motor shaft for engaging a ring gear 199 of the sleeve 180.

Figure 12:
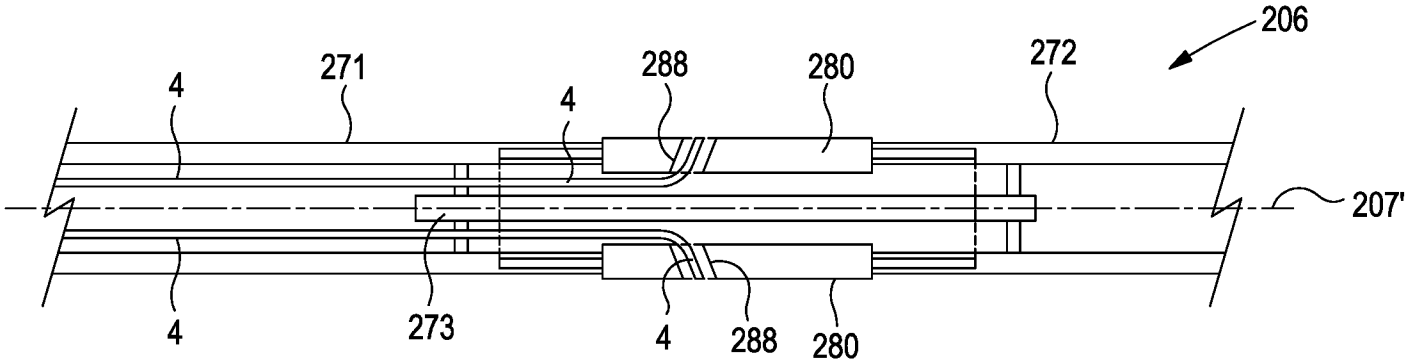
FIG. 12 is a schematic sectional representation of yet another apparatus configured to be incorporated in the wellbore string of FIG. 1 for extracting a flexible tube for forming a lateral bore in a formation of the subsurface.

Another variant is depicted in FIG. 12, in which the sub 206 has a controllable body arranged on a main connecting body in the form of structure that comprises first and second sub members 271, 272 incorporated into the wellbore string and a central connecting shaft 273 connecting the first and second sub members 271, 272. The structure is thus connected in fixed relationship to the adjacent sections of the string. The controllable body is in the form of a rotatable section 280 which is arranged to be rotatable with respect to the connected structure of first and second sub members 271, 272, and connecting shaft 273. Tubes 4 extend in a longitudinal passage between an outer part of the connecting shaft 273 and an inner wall of the sub member 271, and pass through wall ports 288 in the wall of the rotatable section 280. In addition or instead of the connecting shaft 273, other connecting members can be provided.

The term "lateral bore" is used herein generally to refer to bores that extend laterally away from the wellbore including in any rotational orientation with respect to the axis of the main wellbore track. This means that in deviated sections this includes laterals that may not extend horizontally. However, as can be appreciated by way of the technique described above, one can orient the exit to provide horizontal laterals if so desired, for example to facilitate target horizontal pay zones.

The apparatus and methods described above can be advantageous in various ways. In particular, as can be appreciated, by controllably operating the movable body to locate the end of the tube in suitable orientation for extraction in the desired or preferred direction, lateral bores can be produced in the subsurface in particular regions of interest. The tubes can be extracted from oriented ports in predefined positions which allows the formation to be target precisely and in known manner. In thin bed reservoirs for example, stimulation can be obtained reliably with reduced risk of penetrating unwantedly adjacent formations or regions that may not provide optimal drainage of hydrocarbons fluid into the wellbore.

Various other modifications and improvements may be made without departing from the scope of the invention herein described.

The invention claimed is:

1. An apparatus for guiding at least one flexible elongate member from a wellbore string toward a wall of a wellbore, wherein the flexible elongate member is configured for forming at least one lateral bore in a subsurface rock formation for stimulating the formation, the apparatus being configured to be connected to the wellbore string, the apparatus comprising:

a housing configured to be connected to a section of the wellbore string;

a controllable body rotatably arranged inside the housing;

means for detecting a downhole circumferential position or downhole configuration of the controllable body within the wellbore, in use; and a motor;

wherein the controllable body is rotatable with respect to the housing via the motor, based upon the detected downhole circumferential position or detected downhole configuration of the controllable body, into a position in which an exit part of the controllable body is aligned with a window of the housing, such that the aligned exit part and window together provide at least one exit through which the flexible elongate member is extractable from an inside of the wellbore string in a desired and/or preferred direction toward the wall of the wellbore.

2. The apparatus as claimed in claim 1, wherein the controllable body is a sleeve, and the exit part is an exit port.

3. The apparatus as claimed in claim 1, wherein the housing comprises a plurality of windows along a circumference of the housing, and the controllable body is operable to be rotated to obtain alignment with one of the plurality of windows for providing the at least one exit for the flexible elongate member through the window in the desired or preferred direction.

4. The apparatus as claimed in claim 1, further comprising at least one sensor for determining a circumferential position of the controllable body within the wellbore.

5. The apparatus as claimed in claim 1, further comprising at least one determiner for determining an amount of required movement of the controllable body for positioning the controllable body with respect to the wellbore string for providing the at least one exit in the desired or preferred direction.

6. The apparatus as claimed in claim 5, wherein the determiner is configured to be operable for determining the position of the controllable body relative to a position of the window of the housing inside of which the controllable body is positioned and/or determining the window which allows or most closely allows extraction of the flexible elongate member in the desired or preferred direction and/or determining the movement of the controllable body required to provide the at least one exit through said window.

7. The apparatus as claimed in claim 1, wherein the motor is an electric motor for moving the controllable body with respect to the at least one housing for providing the exit for extracting the flexible elongate member in the desired or preferred direction.

8. The apparatus as claimed in claim 7, which further comprises at least one battery for supplying electrical power to the electric motor.

9. The apparatus as claimed in claim 7, further comprising a controller for controlling and operating the electric motor based upon the detected configuration of the controllable body for moving the controllable body with respect to the wellbore string for obtaining the at least one exit for the elongate member from the wellbore string.

10. The apparatus as claimed in claim 9, wherein the controllable body is a sleeve arranged to rotate within a housing and the housing has a gear ring, and the electric motor is mounted to the sleeve and operable to rotate a pinion gear member which is arranged to engage with the gear ring to rotate the sleeve about a longitudinal axis of the wellbore string with respect to the housing for positioning the sleeve.

11. The apparatus as claimed in claim 9, wherein the controllable body is a sleeve arranged to rotate within a housing, and wherein the sleeve incorporates any one or more of:

a battery for supplying power for the electric motor;

a controller for controlling the movement of the motor;

a sensor for detecting the configuration such as the rotational orientation of the sleeve;

a determiner for determining the movement of the sleeve; and electrical circuitry for operating the motor, the sensor, and/or the determiner.

12. The apparatus as claimed in claim 7, wherein the electric motor is arranged to turn at least one gear member for rotating the controllable body circumferentially with respect to the wellbore string.

13. The apparatus as claimed in claim 12, wherein controllable body is configured to be coupled rotatably through the gear member to the wellbore string.

14. A wellbore string including multiple flexible elongate members and incorporating at least one apparatus as claimed in claim 1, the at least one apparatus being connected to the wellbore string.

15. The wellbore string as claimed in claim 14, wherein the controllable body comprises at least one port for supporting and guiding the flexible elongate member upon exiting from the wellbore string.

16. The wellbore string as claimed in claim 14, the controllable body being operable to reconfigure the wellbore string between a first, non-oriented configuration, wherein the body has an arbitrary position with respect to the wellbore string, and a second, oriented configuration, wherein the controllable body is positioned with respect to the wellbore string for allowing the elongate member to exit from the wellbore string in a desired or preferred direction, wherein the controllable body is configured to be positioned in response to actuation based upon the detected configuration within the wellbore, whereby during actuation an end portion of the flexible elongate member to be deployed is located in an exit port of the controllable body, such that upon positioning the controllable body from the first configuration to obtain the second configuration the end of the elongate members are moved with the controllable body.

17. The wellbore string as claimed in claim 14, wherein the elongate member is provided with at least one pressure surface or other member for permitting pressure to be exerted by fluid in the wellbore string for urging the elongate member along the wellbore string and extracting a penetrating end of the elongate member through the at least one exit provided by the positioned controllable body.

18. A method of positioning an exit for extracting at least one flexible elongate member from the wellbore string of claim 14 in a desired or preferred direction in the subsurface.

19. A computer program which, when executed by a computer device, causes the computer device to determine the position of the at least one exit for the flexible elongate member in the method of claim 18.

20. A computer device for use in the method of claim 18, the computer device including the computer program of claim 19.

21. A method of stimulating a subsurface formation using the wellbore string of claim 14.

* * * * *